US008869845B2

(12) United States Patent
Moretti et al.

(10) Patent No.: US 8,869,845 B2
(45) Date of Patent: Oct. 28, 2014

(54) PRESSURIZED GAS DISPENSING DEVICE, ASSEMBLY INCLUDING SUCH A DEVICE AND A CONTROL DEVICE, AND CONTAINER PROVIDED WITH SUCH A DISPENSING DEVICE

(75) Inventors: Alessandro Moretti, Brescia (IT); Philippe Pisot, Lille Adam (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 1017 days.

(21) Appl. No.: 12/993,000

(22) PCT Filed: May 7, 2009

(86) PCT No.: PCT/FR2009/050845

§ 371 (c)(1),
(2), (4) Date: Mar. 14, 2011

(87) PCT Pub. No.: WO2009/150338

PCT Pub. Date: Dec. 17, 2009

(65) Prior Publication Data

US 2011/0155266 A1 Jun. 30, 2011

(30) Foreign Application Priority Data

May 16, 2008 (FR) ..... 08 53163

(51) Int. Cl.
*B65B 1/30* (2006.01)
*F17C 13/04* (2006.01)

(52) U.S. Cl.
CPC ..... *F17C 13/04* (2013.01); *F17C 2205/0332* (2013.01); *F17C 2205/0311* (2013.01); *F17C 2205/0338* (2013.01)
USPC ... 141/197; 141/302; 141/311 R; 137/614.06; 251/149.9; 220/203.19

(58) Field of Classification Search
USPC ..... 137/557, 612, 614.06; 220/203.19; 251/149.9; 141/54, 197, 302, 311 R, 141/368
See application file for complete search history.

(56) References Cited

U.S. PATENT DOCUMENTS

| | | | |
|---|---|---|---|
| 841,196 | A | 1/1907 | Thorp |
| 2,245,847 | A | 6/1941 | Bagby |
| 3,079,178 | A | 2/1963 | Simpkins |
| 3,731,705 | A | 5/1973 | Butler |
| 3,783,841 | A | 1/1974 | Hirschler et al. |
| 4,044,794 | A | 8/1977 | Matthews |
| 4,124,228 | A | 11/1978 | Morrison |
| 4,424,830 | A | 1/1984 | Arnsperger et al. |
| 4,702,277 | A | 10/1987 | Olivier |
| 4,925,196 | A | 5/1990 | Green et al. |
| 5,018,552 | A | 5/1991 | Politi |
| 5,095,947 | A | 3/1992 | Weh et al. |
| 5,127,436 | A | 7/1992 | Campion et al. |
| 5,253,716 | A | 10/1993 | Mitchell |
| 5,323,812 | A | 6/1994 | Wayne |
| 5,458,151 | A | 10/1995 | Wass |
| 5,538,051 | A | 7/1996 | Brown et al. |
| 5,562,117 | A | 10/1996 | Borland et al. |
| 5,694,985 | A | 12/1997 | Diggins |
| 6,035,894 | A | 3/2000 | Weh et al. |
| 6,041,762 | A | 3/2000 | Sirosh et al. |
| 6,047,727 | A | 4/2000 | Hatori et al. |
| 6,257,000 | B1 | 7/2001 | Wang |
| 6,439,278 | B1 | 8/2002 | Krasnov |
| 6,766,829 | B2 | 7/2004 | Takeda et al. |
| 6,997,209 | B2 * | 2/2006 | Ejiri ..... 137/556 |
| 7,013,916 | B1 | 3/2006 | Pearlstein et al. |
| 7,490,864 | B2 | 2/2009 | Cheng |
| 7,558,059 | B2 | 7/2009 | Kamikakoi et al. |
| 7,900,887 | B2 | 3/2011 | Nayrac et al. |
| 7,963,570 | B2 | 6/2011 | Swift et al. |
| 8,186,649 | B2 * | 5/2012 | Aoki ..... 251/149.6 |
| 8,381,763 | B2 | 2/2013 | Moretti et al. |
| 2003/0102051 | A1 | 6/2003 | Hasaka et al. |
| 2004/0000338 | A1 | 1/2004 | Heiderman |
| 2004/0000339 | A1 | 1/2004 | Heiderman |
| 2004/0144803 | A1 | 7/2004 | Baker |
| 2004/0231734 | A1 | 11/2004 | Larsen et al. |
| 2007/0144591 | A1 | 6/2007 | Nakamura |
| 2007/0209718 | A1 | 9/2007 | Hansen |
| 2008/0105310 | A1 | 5/2008 | Ogami et al. |
| 2008/0290657 | A1 | 11/2008 | McKeon, III |

| | | | |
|---|---|---|---|
| 2009/0166359 | A1 | 7/2009 | Pisot |
| 2009/0223580 | A1 | 9/2009 | Denis et al. |
| 2009/0223976 | A1 | 9/2009 | Denis et al. |
| 2010/0059142 | A1 | 3/2010 | Denis |
| 2010/0319804 | A1 | 12/2010 | Moretti et al. |
| 2010/0326540 | A1 | 12/2010 | Moretti et al. |
| 2010/0326561 | A1 | 12/2010 | Moretti et al. |
| 2011/0017318 | A1 | 1/2011 | Pisot |
| 2011/0041933 | A1 | 2/2011 | Pisot et al. |
| 2011/0155266 | A1 | 6/2011 | Moretti et al. |

FOREIGN PATENT DOCUMENTS

| | | |
|---|---|---|
| DE | 10 25 688 | 3/1958 |
| DE | 43 34 182 | 4/1995 |
| EP | 0 401 072 | 12/1990 |
| EP | 0 465 397 | 1/1992 |
| EP | 0 467 769 | 1/1992 |
| EP | 0 476 518 | 3/1992 |
| EP | 1 855 048 | 11/2001 |
| EP | 1 316 755 | 6/2003 |
| EP | 1 367 316 | 12/2003 |
| EP | 1 400 742 | 3/2004 |
| EP | 1 936 174 | 6/2008 |
| FR | 27 35837 | 12/1996 |
| FR | 2 926 871 | 7/2009 |
| FR | 2 927 687 | 8/2009 |
| FR | 2 927 979 | 8/2009 |
| FR | 2 929 368 | 10/2009 |
| FR | 2 930 619 | 10/2009 |
| FR | 2 931 223 | 11/2009 |
| GB | 817 977 | 8/1959 |
| JP | 08 159397 | 6/1996 |
| JP | 11 94197 | 4/1999 |
| JP | 2006 214491 | 8/2006 |
| JP | 2006 242225 | 9/2006 |
| WO | WO 00 15999 | 3/2000 |
| WO | WO 2006 133736 | 12/2006 |
| WO | WO 2007 048954 | 5/2007 |
| WO | WO 2007 048956 | 5/2007 |
| WO | WO 2007 048957 | 5/2007 |
| WO | WO 2009 150388 | 12/2009 |

OTHER PUBLICATIONS

International Search Report for PCT/FR2009/050845, mailed Jan. 15, 2010.
French Search Report for corresponding FR 0850554, Sep. 8, 2008.
International Search Report and Written Opinion for corresponding PCT/FR2009/050123, Aug. 7, 2009.
French Search Report for related FR 0850946, Sep. 10, 2008.
International Search Report and Written Opinion for related PCT/FR2009/050202, Jul. 3, 2009.
French Search Report for related FR 0851105, Sep. 10, 2008.
International Search Report and Written Opinion for related PCT/FR2009/000188, Aug. 14, 2009.
French Search Report for related FR 0851930, Oct. 29, 2008.
International Search Report and Written Opinion for related PCT/FR2009/050477, Sep. 4, 2009.
French Search Report for related FR 0852756, Mar. 19, 2009.
International Search Report and Written Opinion for related PCT/FR2009/050704, Oct. 13, 2009.
French Search Report for related FR 0853163, Sep. 24,2008.
Written Opinion for related PCT/FR2009/050845, Jan. 15, 2010.

* cited by examiner

*Primary Examiner* — Jason K Niesz
(74) *Attorney, Agent, or Firm* — Christopher J. Cronin

(57) ABSTRACT

The invention relates to a pressurized gas dispensing device such as a tap, which includes a first end, to be placed in the opening of a pressurized gas storage tank, and a second end, including a connection interface selectively connectable to a device for controlling the filling and/or withdrawal of gas from the tank, the dispensing device including an internal gas circuit having an upstream end connecting inside the tank and a downstream end to be connected to said filling and/or withdrawal control device, the internal circuit including in series, upstream to downstream, a pressure regulator and a downstream insulation valve, the portion of the internal circuit located between the pressure regulator and the downstream insulation valve defining a so-called low-pressure chamber, the dispensing device; being characterized in that the connection interface includes at least one safety lock selectively movable between a first rest position, wherein the lock shapes the connection interface into a first configuration connectable to said combined filling and/or withdrawal control device, and a second active position, wherein the lock shapes the connection interface into a second configuration preventing connection to a combined filling and/or withdrawal control device, the safety lock being subject to the pressure in the so-called low-pressure chamber directly and/or via an intermediate transmission member such as a movable piston, the safety lock being moved to the active position thereof by the pressure in the low-pressure chamber when the pressure in the low-pressure chamber is greater than a predetermined threshold.

10 Claims, 2 Drawing Sheets

PRESSURIZED GAS DISPENSING DEVICE, ASSEMBLY INCLUDING SUCH A DEVICE AND A CONTROL DEVICE, AND CONTAINER PROVIDED WITH SUCH A DISPENSING DEVICE

CROSS-REFERENCE TO RELATED APPLICATIONS

This application is a §371 of International PCT Application PCT/FR2009/050845, filed May 7, 2009, which claims §119 (a) foreign priority to French application 0853163, filed May 16, 2008.

BACKGROUND

1. Field of the Invention

The present invention relates to a pressurized gas dispensing device, to an assembly comprising such a dispensing device and a control device and to a container provided with such a dispensing device.

The invention relates more specifically to a device for dispensing pressurized gas, such as a tap, comprising a first end intended to be placed in the orifice of a pressurized-gas storage reservoir, and a second end comprising a connection interface that can be connected selectively to a device for controlling the filling and/or the withdrawing of gas from the reservoir, the dispensing device comprising an internal gas circuit having an upstream end intended to communicate with the inside of the reservoir and a downstream end intended to be connected to the said filling and/or withdrawing control device, the internal circuit comprising, in series, from the upstream end downstream, a pressure regulator and a downstream isolation valve, that portion of the internal circuit that lies between the pressure regulator and the downstream isolation valve defining a chamber known as the low-pressure chamber.

2. Related Art

For safety reasons in particular, gas filling and dispensing systems such as taps with in-built regulators are designed so that the end-user of a pressurized-gas cylinder cannot come into contact with the gas at the high pressure of the cylinder but rather only with gas at a pressure that has been reduced by a pressure regulator.

When a valve is fitted downstream of the regulator (on the low-pressure side) an increase in pressure may occur between the regulator and the isolation valve, particularly if the regulator leaks. In particular, no regulator can be considered to be 100% fluidtight, especially in respect of gases with small molecules (of the hydrogen or helium type).

Thus, if the gas is stored for lengthy periods without any gas being withdrawn, the low-pressure chamber downstream of the regulator may fill with gas at a high pressure. When this happens, it creates a situation that is dangerous when the user wishes to withdraw some gas again and connects to the reservoir by opening the isolation valve (via a quick connector for example).

Thus, when the user connects to the withdrawing port and there is an abnormally high pressure upstream of the isolation valve, there is a risk that this will cause the o-rings that seal between the withdrawing port and the quick connector of the user system to become extruded.

Safety problems arise especially in the case where the tap has a filling orifice that is common with the withdrawing orifice.

In order to solve this problem, it is known practice to use safety venting valves which release gas in the event of an overpressure or an excessive temperature. However, even if the leaks are relatively small, under certain situations these known vent valves may also give rise to dangerous situations by suddenly releasing a sizable amount of gas. This is particularly dangerous when the gas is flammable, like hydrogen.

For these reasons, in certain applications, provision may be made for the vent gas released by the safety release valve to be kept in a sealed volume inside the tap. The vent gas is then processed and discharged by a safety system that can be connected to the tap.

Another solution may involve indicating to the user (via a pressure gauge) that the pressure in the tap just behind the valve that isolates it from the outside is abnormally high. However, this approach is not reliable because its safety aspects are entirely reliant upon the user.

It is an object of the present invention to alleviate all or some of the abovementioned disadvantages of the prior art.

SUMMARY OF THE INVENTION

To this end, the device according to the invention, in other respects in accordance with the generic definition given thereof in the above preamble, is essentially characterized in that the connection interface comprises at least one safety lock that can be moved selectively between a first, rest, position in which it configures the connection interface in a first configuration that is connectable to the said mating filling and/or withdrawing control device and an active second position in which it configures the connection interface in a second configuration that prevents connection to a mating filling and/or withdrawing control device, the safety lock being moved into its active position under the action of the pressure in the low-pressure chamber when the pressure in the low-pressure chamber is above a set threshold.

Moreover, embodiments of the invention may comprise one or more of the following features:

- the safety lock is urged by default towards its rest position,
- the safety lock is configured so that, when it switches from its rest position to its active position, it alters at least one of the following structural characteristics of the connection interface: the shape, the volume, the orientation, a dimension,
- the rest and active positions of the safety lock correspond respectively to positions which are retracted and which project with respect to the connection interface,
- the safety lock comprises a ball able to move in a housing formed in the connection interface and opening onto the exterior surface thereof,
- the safety lock is subjected to the pressure in the so-called low-pressure chamber directly and/or via an intermediate transmission member such as a moving piston,
- the internal circuit comprises an additional isolating valve known as the upstream valve arranged in series between the pressure regulator and the downstream isolation valve,
- the internal circuit comprises a safety release valve intended to be subjected to the pressure in the reservoir in order selectively to close off or to open a passage for the gas from the reservoir towards a discharge zone according to the temperature and/or pressure of the gas in the reservoir in relation to at least one set threshold, the discharge zone of the safety release valve opening into the so-called low-pressure chamber upstream of the downstream isolation valve,
- the internal circuit comprises a filling duct intended to fill a reservoir and a withdrawing duct intended to withdraw gas from a reservoir, said filling and withdrawing ducts being common or separate and coinciding at a common end intended to be connected to a filling and/or withdrawing control device so that filling and withdrawing are performed via one and the same access port, the safety lock is urged by default into its rest position by a return member, the filling orifice and the withdrawing orifice coincide in a concave receiving region of the connection interface, the safety release valve is situated in a duct that has a downstream end connected upstream of the downstream isolation valve and an upstream end connected, when mounted on a reservoir, to the inside of the reservoir, the discharge region of the safety release valve is situated between the upstream and downstream valves, the connection interface comprises male and/or female catching means (such as pins, pegs, slots, quick-connection systems, etc.) intended selectively to collaborate by catching with mating female and/or male catching means belonging to a filling and/or withdrawing control device.

The invention may also relate to any alternative device or method comprising any combination of the features mentioned hereinabove or hereinafter.

BRIEF DESCRIPTION OF THE FIGURES

Other specific features and advantages will become apparent from reading the description hereinafter which is given with reference to the figures in which.

DETAILED DESCRIPTION OF THE INVENTION

Figure 1:
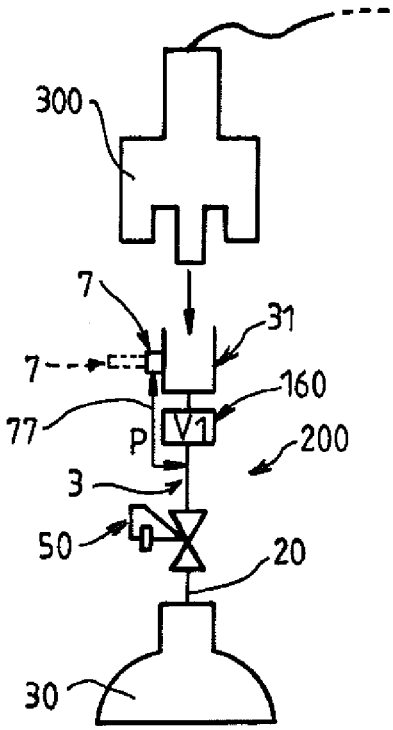
FIG. 1 depicts a schematic and partial view illustrating a first example of the structure and operation of a pressurized gas dispensing device according to the invention.

The pressurized gas dispensing device 200 (such as a tap) depicted schematically in FIG. 1 comprises a body having a first end housed in the orifice of a pressurized gas storage reservoir 30. The body defines an internal gas circuit 20 having one end connected to the inside of the reservoir 30 and a downstream end intended to be connected to a filling and/or withdrawing control device 300 belonging to a user system. For this purpose a second end of the dispensing device 200 comprises a connection interface 31 that can be selectively connected to the device 300 for controlling the filling and/or the withdrawing of gas from the reservoir 30 (for example via a quick-fit connection system).

For example, the connection interface 31 comprises male and/or female catching means (such as pins and/or pegs and/or slots and/or clips and/or screwing systems, etc.) intended selectively to catch on mating female and/or male catching means belonging to the filling and/or withdrawing control device 300.

The internal circuit 20 comprises, from the upstream end downstream (from the cylinder towards the end that can be connected to a user), a pressure regulator 50 and a downstream isolation valve 160 (valve V1), arranged in series.

In this way, the internal circuit 20 is isolated from the outside via the downstream isolation valve 160 which is opened (automatically or as a result of a later specific action) when a control device 300 is connected.

That portion of the dispensing device 200 that lies between the pressure regulator 50 and the downstream isolation valve 160 defines a chamber 3 known as the low-pressure chamber. Specifically, unless there is an anomaly or a leak, the pressure downstream of the regulator 50 ought to be relatively low.

According to an advantageous feature of the invention, the dispensing device 200 comprises at least one safety lock 7 designed to prevent a control device 300 from being connected to the dispensing device 200 when the pressure in the low-pressure chamber 3 is abnormally high (above a set threshold Ps for example). For example, the lock 7 can move selectively between a first, rest, position in which it configures the connection interface 31 in a first configuration that can be connected to said control device 300 and an active second position in which it configures the connection interface 31 in a second configuration that prevents connection to a control device 300.

In this way, in the event of a dangerous situation, the user finds it impossible to make a connection between the control device 300 and the dispensing device 200.

For preference, the safety lock 7 is urged by default toward its rest position and is moved toward its active position under the action of the pressure P in the low-pressure chamber 3 when the pressure P in the low-pressure chamber 3 is above a set threshold Ps.

For example, the safety lock 7 is configured so that, when it moves from its rest position into its active position, it alters at least one of the following structural characteristics of the connection interface 31: the shape, the volume, the orientation, a dimension. For example, and as depicted symbolically in FIG. 1, the rest and active positions of the safety lock 7 may respectively correspond to positions which are retracted and which project (projection has been depicted in dotted line) with respect to the connection interface 31. Thus, when the lock 7 projects, it prevents connection to a control device 300.

The lock 7 is, for example, connected to the low-pressure chamber via a duct 77 formed in the device 200. Preferably also, the safety lock 7 is urged by default toward its rest position by a return member such as a spring. As an alternative, the lock 7 is not urged toward the rest position by a return member but is retracted into the rest position upon connection with a control device 300 (by mechanical contact for example).

Figure 2:
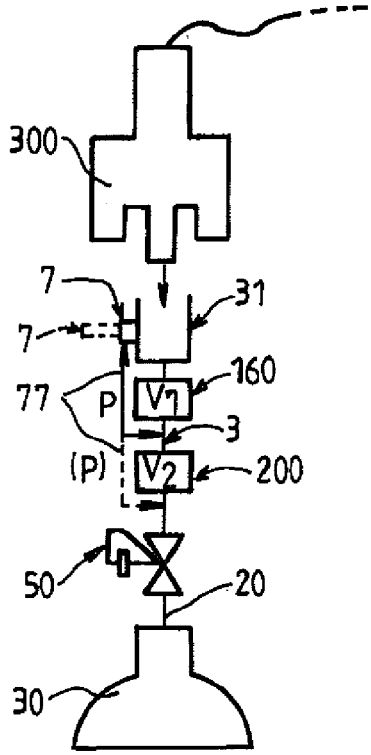
FIG. 2 depicts a schematic and partial view illustrating a second example of the structure and operation of a pressurized gas dispensing device according to the invention.

The embodiment of FIG. 2 differs from that of FIG. 1 only in that the dispensing device 200 comprises, in the internal circuit 20, an additional isolation valve 60 known as the upstream valve 60 positioned in series between the pressure regulator 50 and the downstream isolation valve 160 (valve V2). In this case, the lock 7 can be fluidically linked to the low-pressure chamber 3 which is situated between the two valves (V1, V2) and possibly between the upstream valve 160 and the regulator 50. Put differently, the lock 7 may be sensitive to the pressure between the two valves 160, 60 (V1, V2) and also to the pressure between the upstream valve 160 and the regulator 50.

Figure 3:
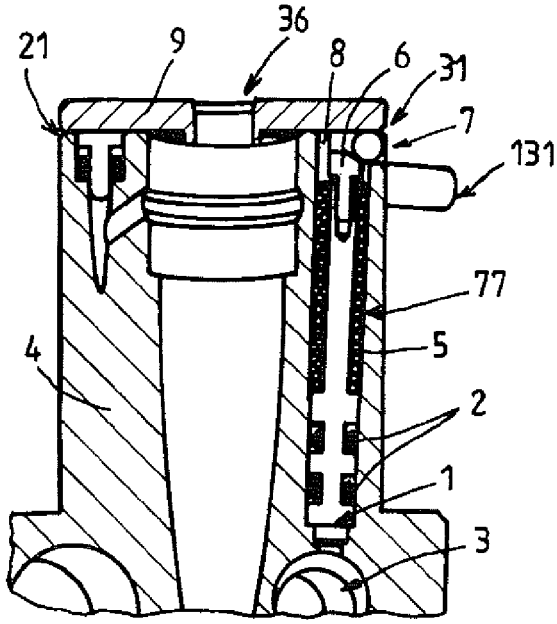
FIGS. 3 and 4 depict views in cross section of one detail of one possible embodiment of a pressurized gas dispensing device according to the invention, illustrating a safety lock in the rest position and in the active position respectively.
Figure 4:
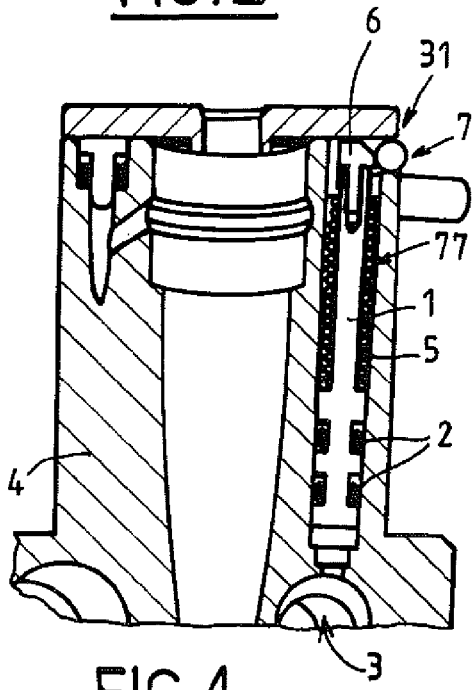

FIGS. 3 and 4 illustrate one possible embodiment according to the invention. The body 4 of the dispensing device 200 comprises an end that forms a connection interface 31. The connection interface 31 is, for example, designed so that it can be partially housed in a connection system of a control device 300. The connection interface 31 has, for example, pins or pegs 131 intended to become housed in mating slots belonging to the control device 300, in order to form an attachment system of the bayonet type for example.

The lock comprises a ball 7 housed in a groove which opens onto the exterior (for example lateral) surface of the connection interface 31. An upper end of the groove may be delimited by a flange 9 attached to and into the body 4 of the dispensing device 200. The flange 9 may have an orifice 36 that forms a system providing guidance towards the inside of the body 4 of the dispensing device 200. For example, the downstream valve 160 is situated in the body 4 and accessible via this orifice 36 in the case of a valve opening system 301 that projects on the control device 300. Without this being limiting, the filling orifice and the withdrawing orifice of the dispensing device 200 may coincide in this concave receiving region 36 of the connection interface 31, 9.

The ball 7 is able to move between a position in which it is retracted into the body 4 and the connection interface 31 and an active position projecting on the exterior surface of the interface body 31 and of the body 4. The groove is of course configured to prevent the ball 7 from coming out completely. The ball 7 is subjected to the pressure in the low-pressure chamber 3 via, for example, a piston 1 sliding in a sealed manner (seals 2) in a channel 77. One end of the piston 1 is subjected to the pressure in the low-pressure chamber 3. Another end of the piston 1 comes into contact with the ball 7, for example via a component 6 that forms an inclined plane. The piston 1 is preferably urged by a spring 5 (or the equivalent) in an opposite direction to the force applied by the gas of the low-pressure chamber 3 (if the pressure P is below a threshold Ps, the spring 5 keeps the piston 1 in a position that does not force the ball 7 toward its projecting position). What that means is that, by default, the ball 7 can move freely in its transverse groove (FIG. 3).

When the pressure P in the low-pressure chamber 3 exceeds a set threshold Ps, the piston 1 pushes the ball 7 back by the inclined plane 6 so that this ball is forced to project beyond the outside diameter of the end forming the connection interface 31.

Thus, the projecting ball 7 forms a protrusion or stop that alters the diameter (or some other feature) of the connection interface 31, thus preventing a control device 300 of complementary shape from being connected thereto even if a relatively high force is applied. This projecting ball 7 also forms a visual indicator alerting a user to the anomaly.

Figure 5:
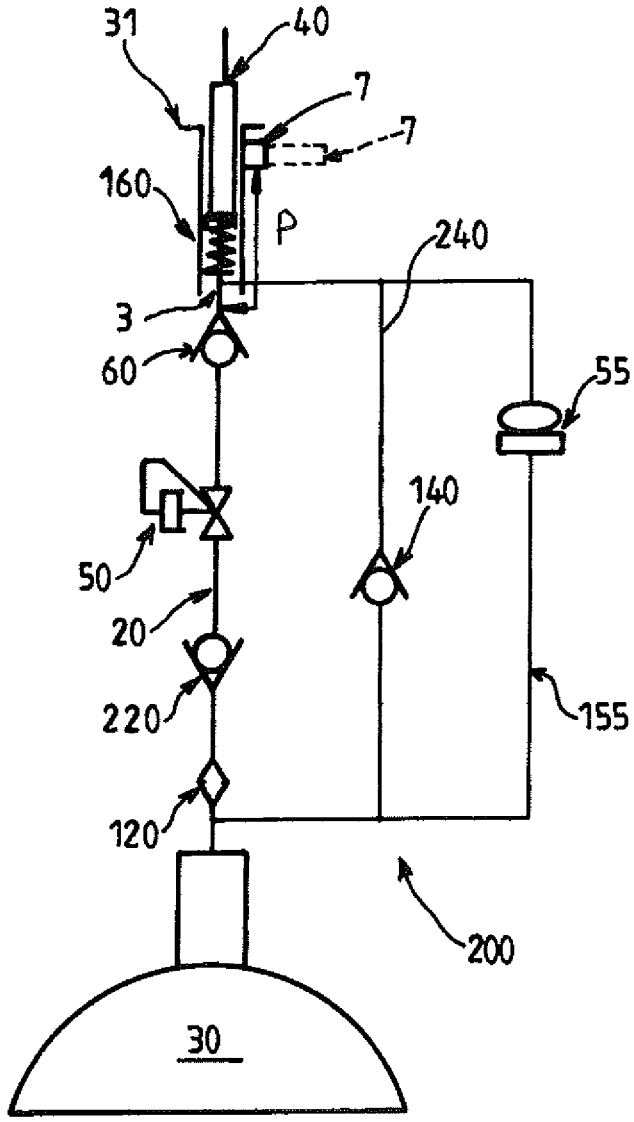
FIG. 5 depicts a schematic and partial view illustrating a third example of the structure and operation of a pressurized gas dispensing device according to the invention.

FIG. 5 illustrates another example of a pressurized gas dispensing device 200 according to the invention. By comparison with the example of FIG. 2, the dispenser 200 of FIG. 5 further comprises a filter 120 and a non-return valve 220 arranged in series upstream of the pressure regulator 50. Moreover, the internal circuit 20 comprises a filling duct 240 provided with a nonreturn valve 140. As depicted, the filling duct 240 may be mounted in parallel with the withdrawing duct which comprises the regulator 50. The upstream end (on the reservoir 30 side) of the filling duct 240 may meet the withdrawing duct (comprising the regulator 50), for example upstream of the filter 120. Likewise, the downstream end (the connection interface 31 end) of the filling duct 240 may meet the withdrawing duct (comprising the regulator 50), for example between the two, upstream 60 and downstream 160, valves. In this way, the filling and withdrawing orifices may be common. Further, the dispensing device 200 may comprise a release valve 55 intended to be subjected to the pressure in the reservoir 30 in order selectively to close off or to open a passage for the gas from the reservoir to a discharge zone according to the temperature and/or pressure of the gas in the reservoir in relation to at least one set threshold. The discharge zone of the safety release valve 55 preferably opens into the low-pressure chamber 3, upstream of the downstream isolation valve 160.

It will be appreciated that while of simple and inexpensive structure, the invention is able to solve all or some of the problems of the prior art.

Of course, the invention is not restricted to the exemplary embodiments described. For example, it is possible to conceive of more locks 7 and different configurations of lock 7 within the scope of the claims (according to the configuration of the connection interface and/or according to the configuration of the filling and/or withdrawing control device connection system).

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A pressurized gas dispensing, comprising a first end intended to be placed in the orifice of a pressurized-gas storage reservoir, and a second end comprising a connection interface that can be connected selectively to a device adapted to control the filling and/or the withdrawing of gas from the reservoir, the dispensing device comprising an internal gas circuit having an upstream end intended to communicate with the inside of the reservoir and a downstream end intended to be connected to the said filling and/or withdrawing control device, the internal circuit comprising, in series, from the upstream end downstream, a pressure regulator and a downstream isolation valve, a portion of the internal circuit that lies between the pressure regulator and the downstream isolation valve defining a low-pressure chamber, wherein the connection interface comprises at least one safety lock that can be moved selectively between a first rest position in which it configures the connection interface in a first configuration in which the device is connectable to the said mating filling and/or withdrawing control device and an active second position in which it configures the connection interface in a second configuration that prevents connection of the device to a mating filling and/or withdrawing control device, the safety lock being subjected to the pressure in the low-pressure chamber directly and/or via a moving piston, the safety lock being moved into its active position under the action of the pressure in the low-pressure chamber when the pressure in the low-pressure chamber is above a set threshold.

2. The device of claim 1, wherein the safety lock is urged by default towards its rest position.

3. The device of claim 1, wherein the safety lock is configured so that, when the safety lock is switched from the rest position to the active position, the safety lock alters at least one of a shape of the connection interface, a volume of the connection interface, an orientation of the connection interface, and a dimension of the connection interface.

4. The device of claim 1, wherein the rest and active positions of the safety lock correspond respectively to positions which are retracted and which project with respect to the connection interface.

5. The device of claim 1, wherein the safety lock comprises a ball able to move in a housing formed in the connection interface and opening onto the exterior surface thereof.

6. The device of claim 1, wherein the internal circuit comprises an additional isolating valve known as the upstream valve arranged in series between the pressure regulator and the downstream isolation valve.

7. The device of claim 1, wherein the internal circuit comprises a safety release valve intended to be subjected to the pressure in the reservoir in order selectively to close off or to open a passage for the gas from the reservoir towards a discharge zone according to the temperature and/or pressure of the gas in the reservoir in relation to at least one set threshold, the discharge zone of the safety release valve opening into the low-pressure chamber upstream of the downstream isolation valve.

8. The device of claim 1, wherein the internal circuit comprises a filling duct intended to fill a reservoir and a withdrawing duct intended to withdraw gas from a reservoir, said filling and withdrawing ducts being common or separate and coinciding at a common end intended to be connected to a filling and/or withdrawing control device so that filling and withdrawing are performed via one and the same access port.

9. An assembly comprising the pressurized gas dispensing device of claim 1 and a device adapted to control the filling and/or withdrawing of gas from the reservoir, wherein the connection interface is connected to the device adapted to control the filling and/or the withdrawing of gas from the reservoir.

10. A pressurized gas container comprising an orifice in which is inserted the first end of the pressurized gas dispensing device of claim 1.

* * * * *

UNITED STATES PATENT AND TRADEMARK OFFICE

CERTIFICATE OF CORRECTION

PATENT NO. : 8,869,845 B2
APPLICATION NO. : 12/993000
DATED : October 28, 2014
INVENTOR(S) : Alessandro Moretti and Philippe Pisot It is certified that error appears in the above-identified patent and that said Letters Patent is hereby corrected as shown below:

Title Page

Item (75) Inventors:

Change "Lille" to -- L'Isle --.

Signed and Sealed this
Seventeenth Day of February, 2015

Michelle K. Lee

Michelle K. Lee
*Deputy Director of the United States Patent and Trademark Office*